US007494375B2

(12) United States Patent
Yoshikai

(10) Patent No.: US 7,494,375 B2
(45) Date of Patent: Feb. 24, 2009

(54) CONNECTOR FOR CONNECTING A FLEXIBLE PRINTED CIRCUIT BOARD

(75) Inventor: Yasuyoshi Yoshikai, Kawasaki (JP)

(73) Assignee: Iriso Electronics Co., Ltd., Kawasaki-shi (JP)

( * ) Notice: Subject to any disclaimer, the term of this patent is extended or adjusted under 35 U.S.C. 154(b) by 57 days.

(21) Appl. No.: 10/599,932

(22) PCT Filed: Jun. 30, 2005

(86) PCT No.: PCT/JP2005/012090

§ 371 (c)(1),
(2), (4) Date: Oct. 13, 2006

(87) PCT Pub. No.: WO2006/100789

PCT Pub. Date: Sep. 28, 2006

(65) Prior Publication Data

US 2007/0224882 A1 Sep. 27, 2007

(30) Foreign Application Priority Data

Mar. 24, 2005 (JP) ..... 2005-086397

(51) Int. Cl.
*H01R 9/05* (2006.01)

(52) U.S. Cl. ..... 439/595

(58) Field of Classification Search ..... 439/595, 439/260, 494, 496, 261
See application file for complete search history.

(56) References Cited

U.S. PATENT DOCUMENTS 7,052,300 B2 * 5/2006 Okita et al. ..... 439/260
7,112,079 B2 * 9/2006 Miura et al. ..... 439/260
7,261,589 B2 * 8/2007 Gillespie et al. ..... 439/495

FOREIGN PATENT DOCUMENTS

| | | |
|---|---|---|
| JP | 08-180940 | 7/1996 |
| JP | 11-074043 | 3/1999 |
| JP | 2003-100370 | 4/2003 |
| JP | 2004-165046 | 6/2004 |
| JP | 2000-182697 | 10/2006 |

* cited by examiner

*Primary Examiner*—Jean F Duverne
(74) *Attorney, Agent, or Firm*—Lowe Hauptman Ham & Berner LLP

(57) ABSTRACT

A connector is provided which can confirm full insertion of an object to be connected by feeling at insertion manipulation and can temporarily hold the object to be connected surely. Each of lock portions is formed by a non-elastic member. On both ends in the terminal arranging direction of a connector body is provided a temporary holding member which is elastically deformed upward in contact with an upper face of a flexible cable inserted into the connector body and recovered while urging the flexible cable downward when a notch portion of the flexible cable is fitted with the lock portion. By this, when each of the notch portions of the flexible cable is fitted with each of the lock portions, the feeling that the flexible cable urged by the temporary holding member is fitted with each of the lock portions while being pressed downward can be obtained through the flexible cable. Therefore, incomplete insertion of the flexible cable can be surely prevented.

14 Claims, 6 Drawing Sheets

CONNECTOR FOR CONNECTING A FLEXIBLE PRINTED CIRCUIT BOARD

TECHNICAL FIELD

The present invention relates to a connector for connecting a flexible print circuit board (FPC) flexible flat cable (FFC), etc., for example.

BACKGROUND ART

As this type of connector, such a connector is known that is provided with a connector body to which one end of an object to be connected can be inserted at a predetermined position, a plurality of terminals in contact with the object to be connected which was inserted into the connector body, and a pressing member for pressing the object to be connected which was inserted into the connector body on each of the terminals side and in which removal of the object to be connected from the connector body before being pressed by the pressing member or occurrence of contact failure due to displacement is prevented by providing a temporary holding member for temporarily holding the object to be connected at a contact portion between a conductive portion provided on the object to be connected and the terminals.

However, with this connector, it is not possible to confirm that the object to be connected has been temporarily held by the temporary holding member, and there is a case that the conductive portion of the object to be connected is brought into contact with and electrically connected with each of the terminals in the state where the object to be connected is not fully inserted into the connector body. At this time, there are problems that the object to be connected is withdrawn from the connector body before being pressed by the pressing member to the terminal side and that displacement between the object to be connected and each of the terminals results in contact failure or breakage such as streaks on the conductive portion of the object to be connected.

Then, such a connector is known in which an elastic support piece for locking the object to be connected is provided on both ends within the connector body in the terminal arranging direction so that a notch portion provided on both side ends of the object to be connected is fitted with the elastic support piece when the object to be connected is inserted into the connector body and the object to be connected is temporarily held by the locking with the elastic support piece to regulate movement of the object to be connected in the direction opposite to insertion (See the Patent Document 1, for example).

However, even in the state where the object to be connected is temporarily held by the connector body with the elastic support piece, when the object to be connected is withdrawn in the direction opposite to insertion, the elastic support piece is elastically deformed and fitting with the object to be connected is released. By this, the object to be connected becomes capable of movement within the connector body. Therefore, since the object to be connected is temporarily held in the insufficient state as mentioned above, withdrawal of the object to be connected from the connector body or breakage such as streaks on the conductive portion of the object to be connected can not be prevented.

[Patent Document 1]: Japanese Patent Publication 2003-100370

The present invention was made in view of the above problems and has an object to provide a connector which can confirm full insertion of an object to be connected by feeling at insertion manipulation and can temporarily hold the object to be connected surely.

DISCLOSURE OF THE INVENTION

In order to achieve the above object, the present invention is, in a connector provided with a connector body to which one end of an object to be connected can be inserted at a predetermined position, a plurality of terminals in contact with the object to be connected inserted into the connector body and a pressing member for pressing the object to be connected to each of the terminals side by being inserted into the connector body, in which a lock portion is projected on both ends of the connector body in the terminal arranging direction and when the object to be connected is inserted into the connector body, the tip end side of the object to be connected overrides the lock portion and a notch portion provided on both side ends of the object to be connected is fitted with the lock portion and locked in the direction opposite to insertion, the lock portion is formed by a non-elastic member and a temporary holding member which is elastically deformed in a predetermined direction while being in contact with one face of the object to be connected inserted into the connector body and is recovered while urging the object to be connected in the direction of fitting with the lock portion when the notch portion of the object to be connected is fitted with the lock portion is provided on both ends in the terminal arranging direction of the connector body.

By this, when the object to be connected is fully inserted into the connector body, that is, the notch portion of the object to be connected is fitted with the lock portion, feeling that the object to be connected which is urged by the temporary holding member is fitted while being pressed in the direction of fitting with the lock portion is obtained through the object to be connected. Also, since the object to be connected is locked in the direction opposite to insertion, the object to be connected is not moved in the direction opposite to insertion.

Also, in the present invention, in a connector provided with a connector body to which one end of an object to be connected can be inserted at a predetermined position, a plurality of terminals in contact with the object to be connected inserted into the connector body and a pressing member for pressing the object to be connected to each of the terminal side by being inserted into the connector body, a temporary holding member which is elastically deformed in a predetermined direction while being in contact with one face of the object to be connected which was inserted into the connector body and is recovered and fitted with a notch portion provided on both side ends of the object to be connected when the object to be connected is inserted to a predetermined position of the connector body is provided on both ends of the connector body in the terminal arranging direction.

By this, when the object to be connected is fully inserted into the connector body, that is, the object to be connected is inserted to a predetermined position of the connector body, feeling that the temporary holding member is recovered to the original shape and is fitted with the notch portion of the object to be connected is obtained through the object to be connected. Also, since the notch portion of the object to be connected is fitted with the temporary holding member, the object to be connected is not moved in the direction opposite to insertion.

According to the present invention, since full insertion of the object to be connected into the connector body can be confirmed by feeling at insertion manipulation, the object to be connected is not connected in the incomplete insertion state and moreover, the object to be connected can not be moved in the direction opposite to insertion. And withdrawal of the object to be connected from the connector body or contact failure or breakage on the conductive portion of the object to be connected can be surely prevented.

BRIEFLY DESCRIBE OF THE DRAWINGS

DESCRIPTION OF SYMBOLS

10 . . . Connector body, 20 . . . Terminal, 30 . . . Pressing member, 40 . . . Temporary holding member, 41*a* . . . Projecting piece, 42 . . . Connection portion, A . . . Flexible cable, A2 . . . Notch portion, A2*a* . . . Front end face

BEST MODE FOR CARRYING OUT THE INVENTION

Figure 1:
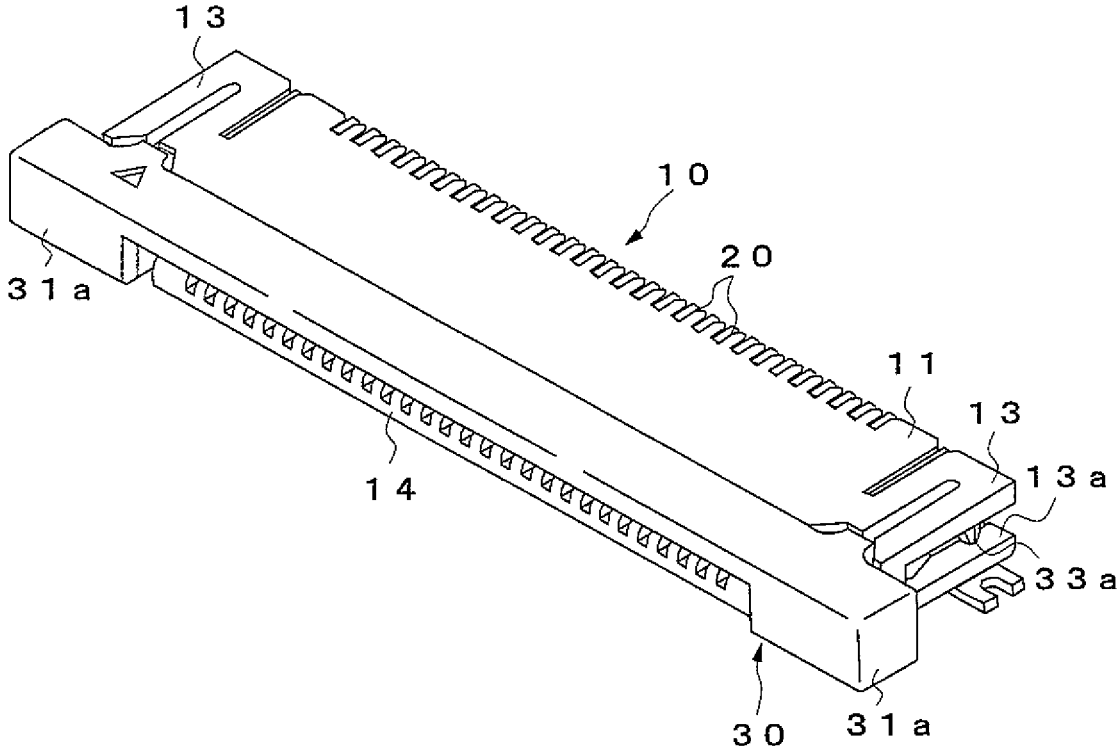
FIG. 1 is a perspective view of a connector according to a first preferred embodiment of the present invention.
Figure 2:
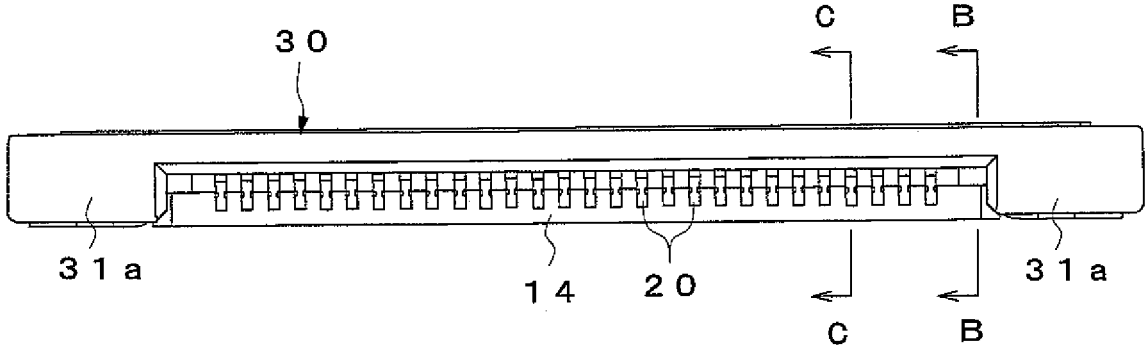
FIG. 2 is a front view of a connector according to the first preferred embodiment of the present invention.
Figure 3:
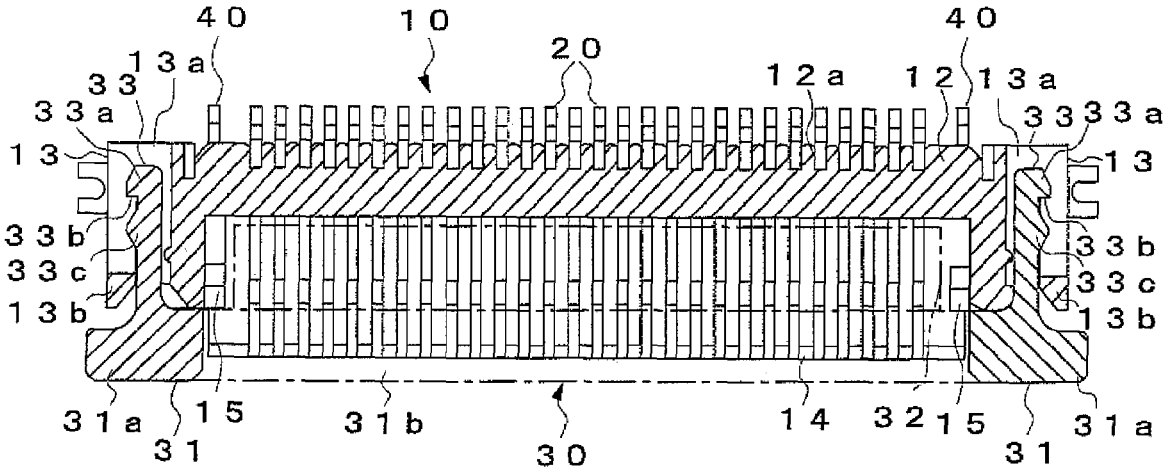
FIG. 3 is a sectional plan view of a connector according to the first preferred embodiment of the present invention.
Figure 4:
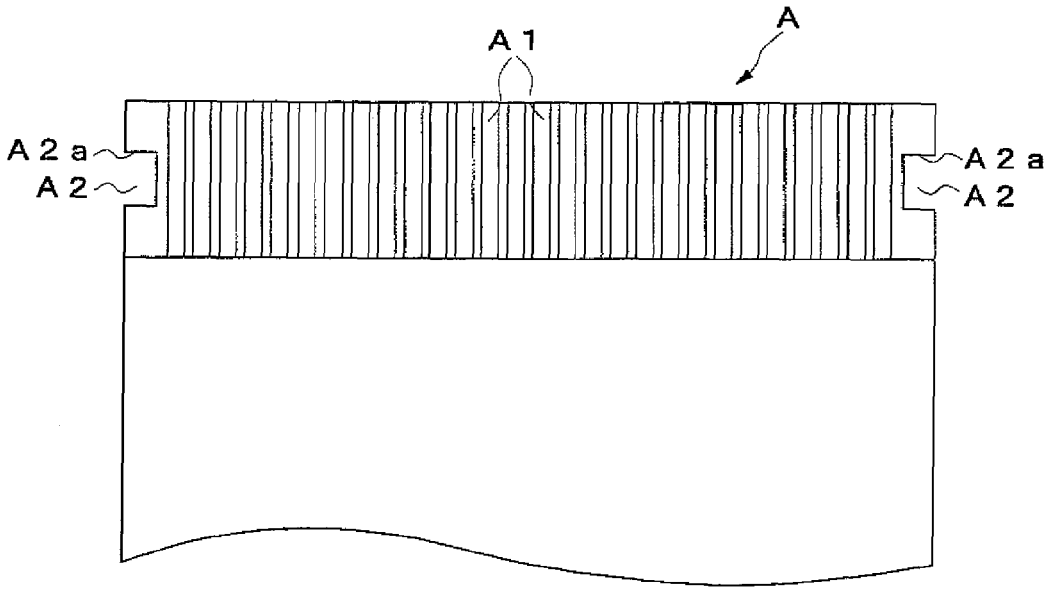
FIG. 4 is a plan view of a flexible cable according to the first preferred embodiment of the present invention.
Figure 5:
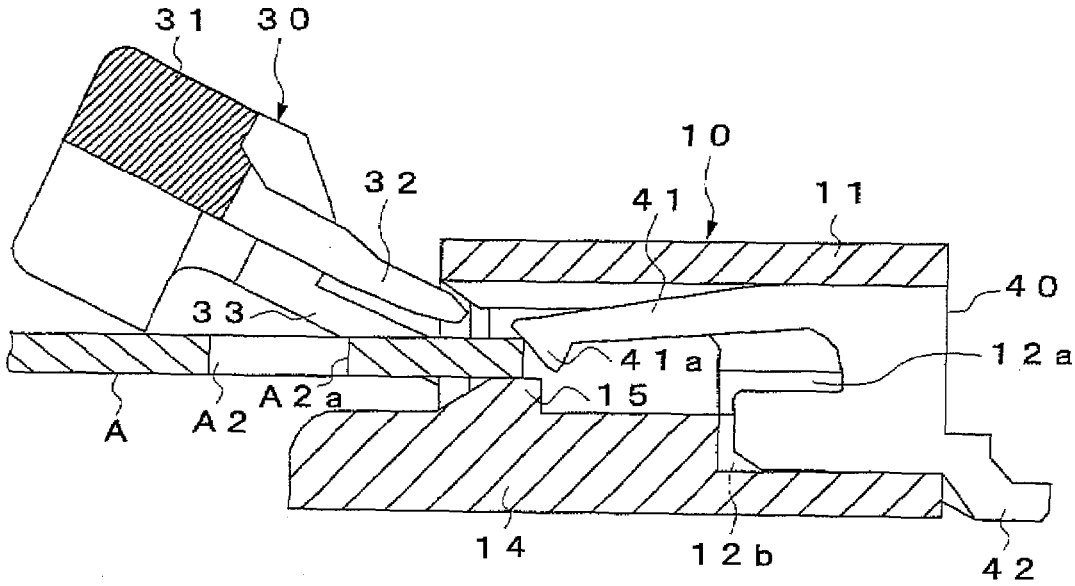
FIG. 5 is a B-B sectional view showing operation of a connector according to the first preferred embodiment of the present invention.
Figure 6:
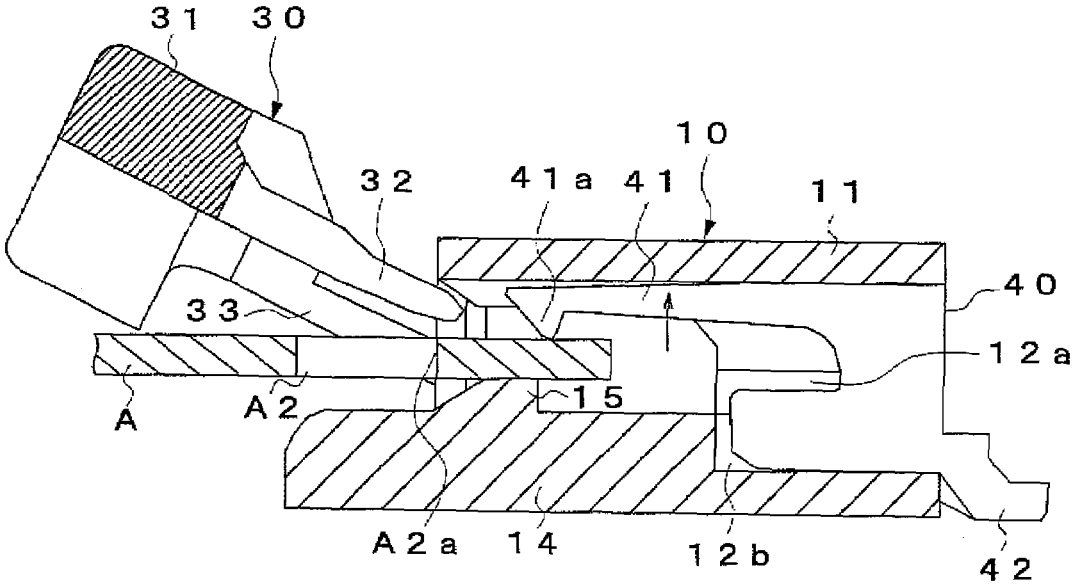
FIG. 6 is a B-B sectional view showing operation of a connector according to the first preferred embodiment of the present invention.
Figure 7:
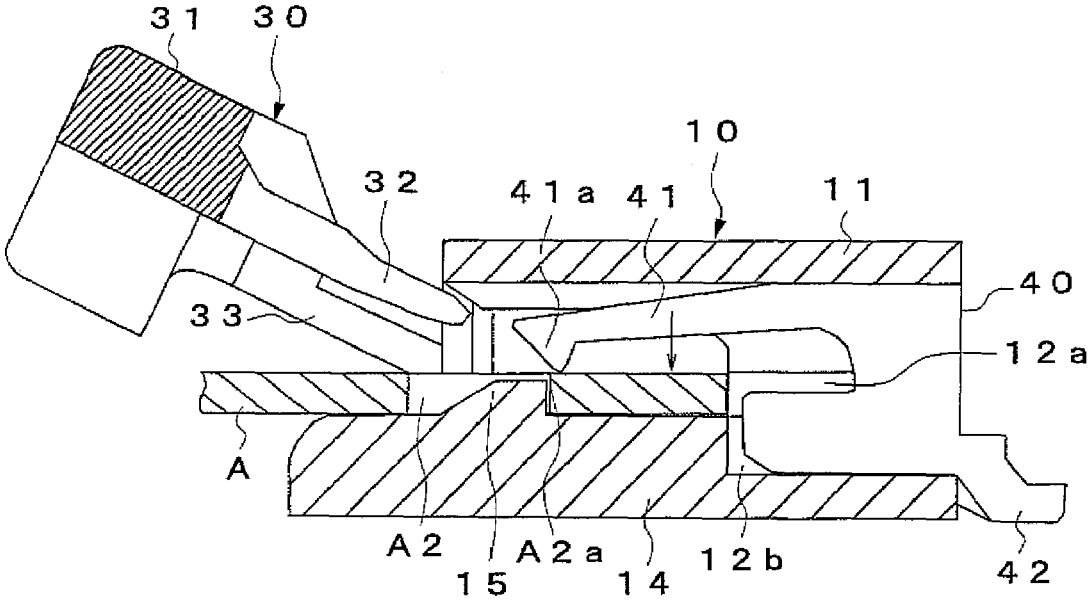
FIG. 7 is a B-B sectional view showing operation of a connector according to the first preferred embodiment of the present invention.
Figure 8:
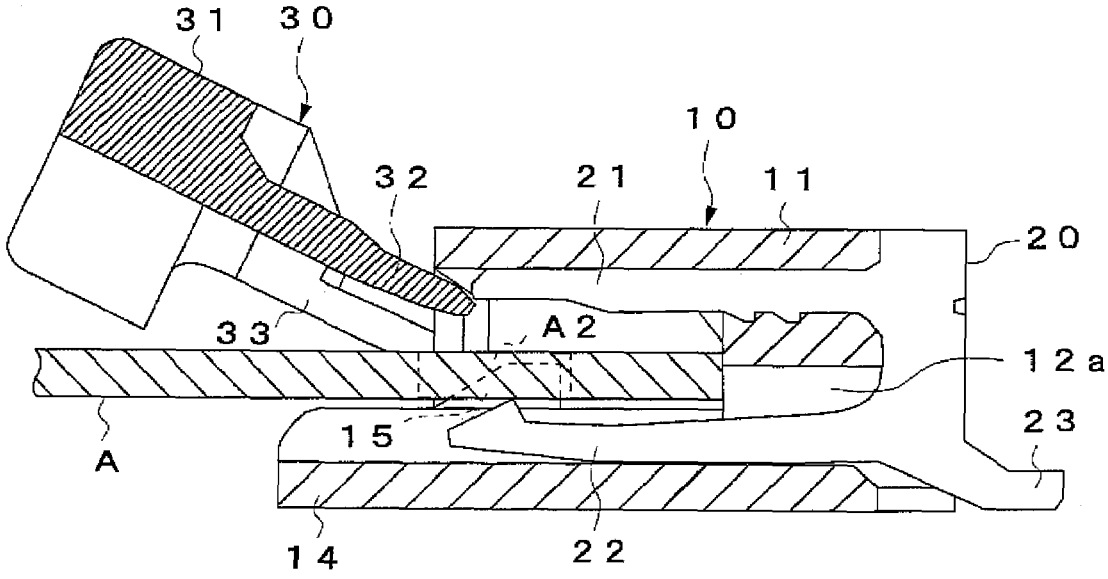
FIG. 8 is a C-C sectional view showing operation of a connector according to the first preferred embodiment of the present invention.

FIGS. 1 to 8 show a first preferred embodiment of the present invention, in which FIG. 1 is a perspective view of a connector, FIG. 2 is a front view of a connector, FIG. 3 is a sectional plan view of a connector, FIG. 4 is a plan view of a flexible cable, FIGS. 5 to 7 are B-B sectional views showing operation of a connector and FIG. 8 is a C-C sectional view showing operation of a connector.

This connector is constituted by a connector body 10 to which one end of a flexible cable A as an object to be connected can be inserted, a plurality of terminals 20 in electric contact with a contact of the flexible cable A inserted into the connector body 10, a pressing member 30 for pressing the flexible cable A to each of the terminals 20 side and a temporary holding member 40 for temporarily holding the flexible cable A inserted into the connector body 10.

The flexible cable A is what is called as flexible flat cable (FFC), in which a plurality of conductive portions A1 are provided on both an upper and a lower surfaces at its tip end with an interval to each other in the width direction. Also, at the both side ends of the flexible cable A are provided a pair of right and left notch portions A2, and a front surface of each of the notch portions A2, that is, the surface by which each of the temporary holding members 40 is locked is formed by a front end face A2*a* forming a flat surface downward. The object to be connected may be a flexible print circuit (FPC) or the like.

The connector body 10 is made of a molded product of a non-elastic material (synthetic resin, for example) and the front face side is formed in the opened box state. That is, the connector body 10 is constituted by an upper face portion 11, a back face portion 12, side face portions 13 and a bottom face portion 14, and the flexible cable A is inserted through its front face opening. On the back face portion 12, a plurality of terminal holes 12*a* are provided with an equal interval in the width direction, and each of the terminals 20 is respectively held in each of the terminal holes 12*a*. Also, on the both ends in the arranging direction of each of the terminal holes 12*a*, a pair of temporary holding holes 12*b* are provided, and each of the temporary holding members 40 is respectively held in each of the temporary holding holes 12*b*. On each of the side face portions 13, an elongated hole 13*a* extending in the fore-and-aft direction, respectively, is provided, and the pressing member 30 is engaged with each of the elongated holes 13*a* and the pressing member 30 is locked by a front end 13*b* of each of the elongated holes 13*a*. On both ends in the arranging direction of each of the terminal holes 12*a*, a pair of right and left lock portions 15 integrally formed with the connector body 10 are projected upward, and each of the notch portions A2 of the flexible cable A is locked by each of the lock portions 15. Also, each of the lock portions 15 is formed higher than the height of each of the terminals 20 protruding in the direction in contact with the flexible cable A, that is, upward, and its front end is formed so that it makes an ascending inclination toward the rear of the connector body 10.

Each of the terminals 20 is made of a conductive metal plate and respectively held by each of the terminal holes 12*a* of the connector body 10. Each of the terminals 20 has a fixed piece portion 21 and an elastic piece portion 22 extending in the bifurcated state forward with an interval to each other in the vertical direction, and a board connection portion 23 to be connected to a board (not shown) is provided at its rear end.

The pressing member 30 is made of a molded product of a synthetic resin and is constituted by a manipulation portion 31 arranged outside the connector body 10, a pressing piece 32 arranged within the connector body 10 and a pair of right and left arm portions 33 to be inserted into the connector body 10. The manipulation portion 31 extends in the width direction of the pressing member 30, and a gripping portion 31*a* is projected on its both ends. Also, the manipulation portion 31 is provided with a recess portion 31*b* at the center on the lower face through which the flexible cable A can be inserted. The pressing piece 32 extends rearward from the center on the back face of the manipulation portion 31 and is located below the fixed piece portion 21 of each of the terminals 20. Also, the thickness dimension of the pressing piece 32 is formed so that it becomes gradually smaller toward the tip end. Each of the arm portions 33 extends rearward from the both ends on the back face of the manipulation portion 31 and is inserted into each of the elongated holes 13*a* of the connector body 10, respectively, capable of movement in the fore-and-aft direction. Also, a lock piece 33*a* to be locked by the front end portion 13*b* of the elongated hole 13*a* is provided at the tip end of each of the arm portions 33 so that it protrudes in the width direction, and the front face of the lock piece 33*a*, that is, the face locked by the front end portion 13*b* of each of the elongated holes 13*a* is formed by an inclined surface 33*b* forming a rearward descending inclination. Also, at the center in the fore-and-aft direction of each of the arm portions 33 is provided an angular projection portion 33*c* projecting in the width direction, and when the arm portion 33 is moved in the fore-and-aft direction, the projection portion 33*c* forcibly overrides the front end portion 13*b* of the elongated hole 13*a* by elastic deformation of the arm portion 33.

Each of the temporary holding members 40 is made of a conductive metal plate and respectively held in each of the temporary holding holes 12*b* of the connector body 10. On an upper part of each of the temporary holding members 40 is provided an elastic piece 41 formed so that it is elastically deformed, and at the tip end of the elastic piece 41 is provided a downwardly projecting projection piece 41*a*. Also, at the rear end of each of the temporary holding members 40, a connection portion 42 to be connected to a board is provided.

In the connector constituted as above, by soldering the board connection portion 23 of each of the terminals 20 and the connection portion 42 of each of the temporary holding members 40 to a board, each of the terminals 20 and each of the temporary holding members 40 are connected to the board. Also, when the flexible cable A is to be connected to the connector, by withdrawing the pressing member 30 forward as shown in FIG. 5, the flexible cable A becomes capable of being inserted into the connector body 10. That is, the thickness dimension of the pressing piece 32 of the pressing member 30 is formed so that it is gradually reduced toward the tip end side, and when the pressing member 30 is moved forward, a gap between the bottom face portion 14 and the pressing piece 32 is widened, and the flexible cable A becomes capable of being inserted between the bottom face portion 14 and the pressing piece 32. Also, when the pressing member 30 is withdrawn forward, the projection portion 33*c* of each of the arms 33 overrides the front end portion 13*b* of the elongated hole 13*a* and the lock piece 33*a* of the arm portion 33 is locked by the front end portion 13*b* of the elongated hole 13*a*, by which the pressing member 30 is held at the withdrawn position. At that time, the inclined surface 33*b* of the lock piece 33*a* is brought into contact with the front end portion 13*b* of the elongated hole 13*a*, and the inclined surface 33*b* tends to be perpendicular along the front end portion 13*b* of the elongated hole 13*a* by the holding force by the projection portion 33*c* toward the front position of the pressing member 30. By this, as shown in FIG. 5, the pressing member 30 is moved rotationally upward and its front end side is raised, by which insertion of the flexible cable A is facilitated.

Next, when the flexible cable A is inserted into the connector body 10, both ends in the width direction at the tip end of the flexible cable A are brought into contact with the front end of each of the lock portions 15 and then, goes onto the upper face of each of the lock portion 15 while being guided by the inclined surface on the front end side of each of the lock portions 15. And as shown in FIG. 6, after both ends in the width direction at the tip end of the flexible cable A are brought into contact with each of the temporary holding members 40, the elastic piece 41 of each of the temporary holding members 40 is elastically deformed upward along the upper face of the flexible cable A. Moreover, as shown in FIG. 7, when the flexible cable A is inserted toward the rear of the connector body 10, the tip end of the flexible cable A overrides each of the lock portions 15, and each of the notch portions A2 of the flexible cable A and each of the lock portions 15 of the connector body 10 are fitted with each other and the flexible cable A is moved downward. At this time, the elastic piece 41 of each of the elastically deformed temporary holding members 40 is recovered to the original shape while urging the flexible cable A downward. And the feeling that the flexible cable A is fitted with each of the lock portions 15 while being pressed by each of the temporary holding members 40 is transmitted to the outside through the flexible cable A. Also, when each of the notch portions A2 of the flexible cable A is fitted with each of the lock portions 15, each of the conductive portions A1 of the flexible cable A is brought into contact with the elastic piece portion 22 of each of the terminals 20 as shown in FIG. 8, and each of the notch portions A2 of the flexible cable A is locked by each of the lock portions 15. By this, the flexible cable A is temporarily held by each of the temporary holding members 40 within the connector 10. In this case, the flexible cable A is locked by each of the lock portions 15 made of a non-elastic member in the direction opposite to insertion, that is, at the front of the connector body 10, and the flexible cable A is not withdrawn from the connector body 10 due to release of the locking caused by deformation of each of the lock portions 15 or displacement is not generated between it and each of the terminals 20. Moreover, since the temporary holding members 40 is connected to the board through the connection portion 42, it is not withdrawn with the flexible cable A to the front of the connector body 10.

In this way, according to the connector of this preferred embodiment, the lock portion 15 formed by the non-elastic member for fitting with the notch portion A2 of the flexible cable A and locking the flexible cable A in the direction opposite to insertion is provided on both ends in the arranging direction of each of the terminals 20 of the connector body 10, and the temporary holding member 40 is elastically deformed upward in contact with the upper face of the flexible cable A inserted into the connector body 10 and when the notch portion A2 of the flexible cable A is fitted with the lock portion 15, it is recovered while urging the flexible cable A downward. Thus, when the flexible cable A is fully inserted into the connector body 10, that is, when each of the notch portions A2 of the flexible cable A is fitted with each of the lock portions 15, the feeling that the flexible cable A urged by the temporary holding member 40 is fitted with each of the lock portions 15 while being pressed downward is obtained through the flexible cable A. Also, the flexible cable A can not be withdrawn to the front of the connector body 10. Therefore, incomplete insertion of the flexible cable A can be prevented, and withdrawal of the flexible cable A from the connector body 10 or displacement between the conductive portion A1 of the flexible cable A and the elastic piece portion 22 of each of the terminals 20 and resultant contact failure can be surely prevented.

Moreover, since each of the lock portions 15 is integrally formed with the connector body 10, displacement of each of the lock portions 15 due to contact with the flexible cable A, which causes non-fitting between the notch portion A2 of the flexible cable A and each of the lock portions 15 can be prevented, and when the flexible cable A is fully inserted, each of the notch portions A2 of the flexible cable A and each of the lock portions 15 can be surely fitted with each other.

Moreover, since the front end of each of the lock portions 15 is formed so that it is inclined upward toward the rear of the connector body 10, after the both ends in the width direction at the tip end of the flexible cable A are brought into contact with the front end of each of the lock portions 15, the flexible cable A goes onto the upper face of each of the lock portions 15 while being guided by the inclined surface at the front end of each of the lock portions 15 and the flexible cable A can be inserted to the rear of the connector body 10 easily. Therefore, there is an advantage that, when the flexible cable A is inserted into the connector body 10, insertion is not prevented by contact between the tip end of the flexible cable A and the front end of each of the lock portions 15.

Moreover, since each of the lock portions 15 is formed higher than the height of each of the terminals 20 in the direction in contact with the flexible cable A, that is, protruding upward, each of the conductive portions A1 of the flexible cable A is not brought into contact with each of the terminals 20 when the flexible cable A is inserted into the connector body 10. Therefore, damage such as streaks on each of the conductive portions A1 of the flexible cable A due to contact with each of the terminals 20 can be surely prevented.

Constitution of the case where the lock portions are not provided will be described below as a second preferred embodiment of the present invention.

Figure 9:
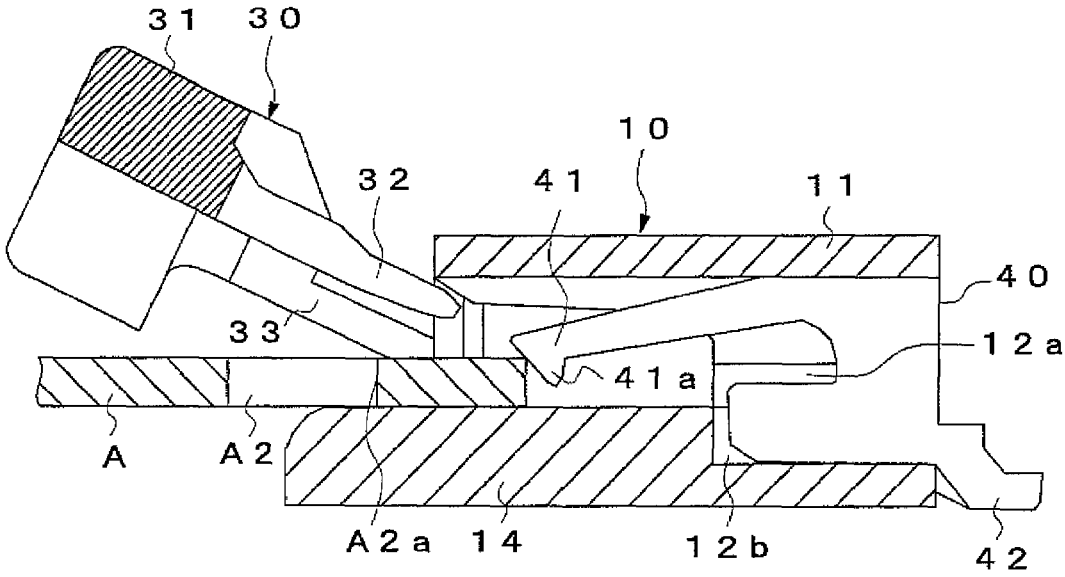
FIG. 9 is a B-B sectional view showing operation of a connector according to a second preferred embodiment of the present invention.
Figure 10:
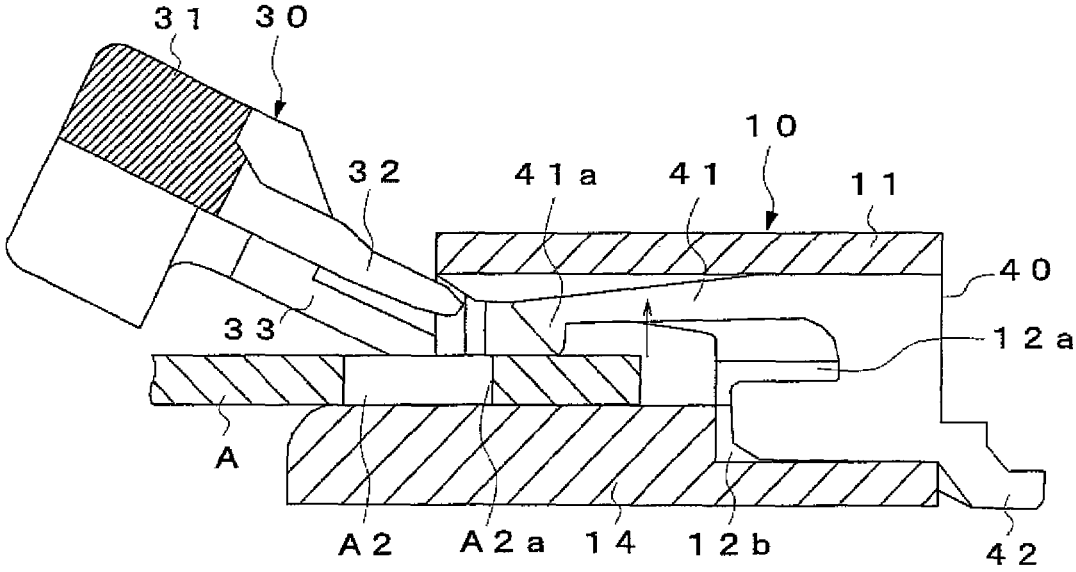
FIG. 10 is a B-B sectional view showing operation of a connector according to the second preferred embodiment of the present invention.
Figure 11:
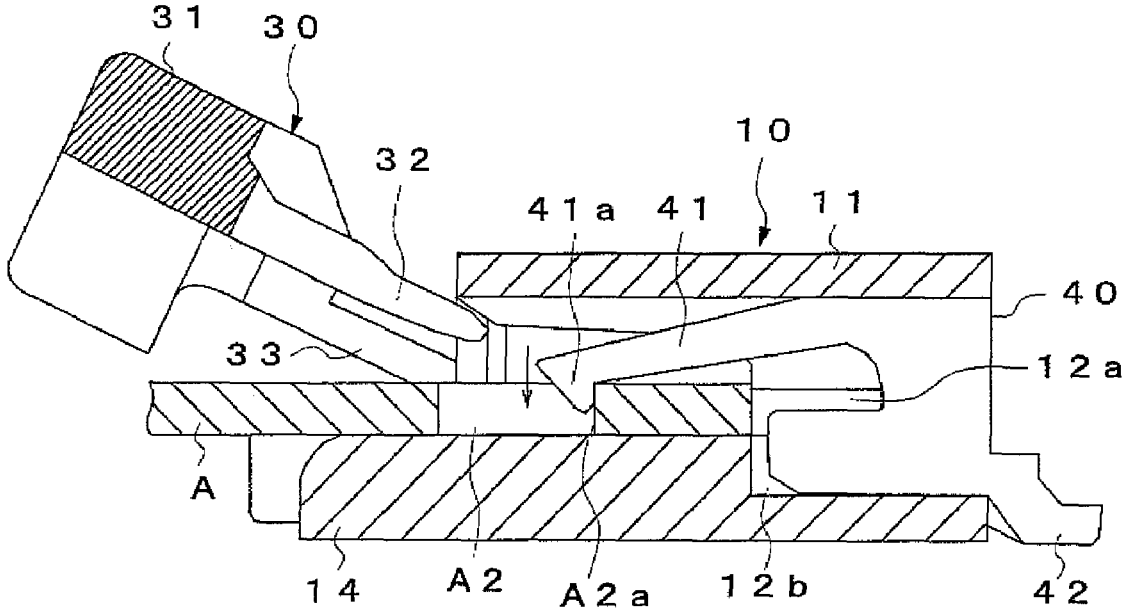
FIG. 11 is a B-B sectional view showing operation of a connector according to the second preferred embodiment of the present invention.
Figure 12:
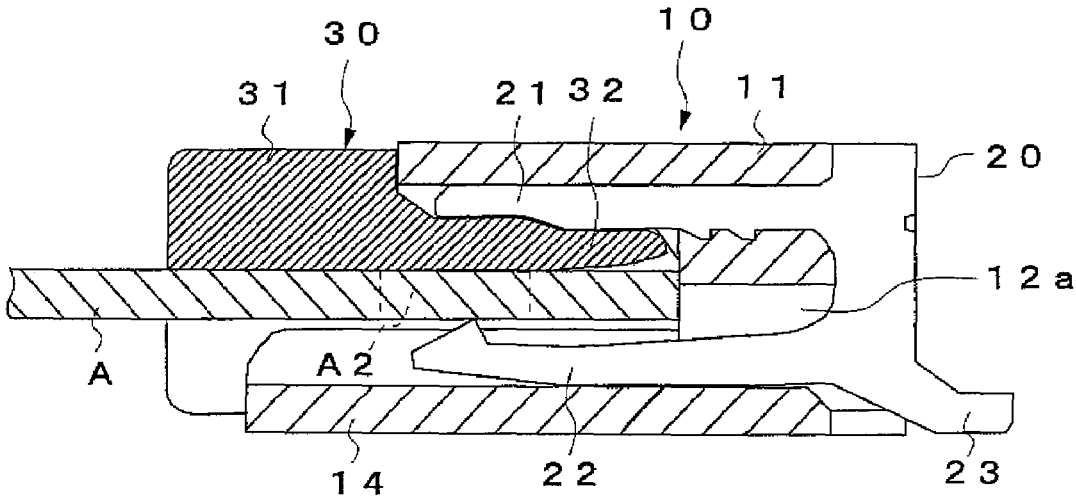
FIG. 12 is a C-C sectional view showing operation of a connector according to the second preferred embodiment of the present invention.

FIGS. 9 to 11 are B-B sectional views showing operation of the connector, FIG. 12 is a C-C sectional view showing the operation of the connector, and in FIGS. 9 to 12, the same reference numerals are given to the same constitutional portions in the above preferred embodiment so as to omit the explanation. As shown in FIG. 9, each of the lock portions 15 are not provided on the connector body 10.

Here, as shown in FIG. 9, when the flexible cable A is to be inserted into the connector body 10, the flexible cable A is inserted along the upper face of the bottom face portion of the connector body 10. And as shown in FIG. 10, after the both ends in the width direction at the tip end of the flexible cable A is brought into contact with each of the temporary holding members 40, the elastic piece 41 of each of the temporary holding members 40 is elastically deformed upward along the upper face of the flexible cable A. Moreover, as shown in FIG. 11, when the flexible cable A is inserted toward the rear of the connector body 10, the tip end of the flexible cable A is brought into contact with the front face of each of the terminal holes 12*a*, and movement of the flexible cable A in the insertion direction is regulated at the contact position. At this time, the elastic piece 41 of each of the elastically deformed temporary holding members 40 is fitted with the notch portion A2 of the flexible cable A while recovering to the original shape and moreover, the projection piece 41*a* of the elastic piece 41 is brought into contact with the front end face A2*a* of the notch portion A2. By this, the flexible cable A is temporarily held by each of the temporary holding portions 40 within the connector 10. In this case, the feeling that the flexible cable A is pressed downward by each of the temporary holding members 40 when each of the temporary holding members 40 is fitted with the flexible cable A is transmitted to the outside through the flexible cable A. Also, since the flexible cable A is locked by the terminal hole 12*a* and the temporary holding portion 40 in the fore-and-aft direction, it is not withdrawn from the connector body 10 or displaced with respect to each of the terminals 20. Moreover, since each of the temporary holding members 40 is connected to the board through the connection portion 42, it is not withdrawn with the flexible cable A to the front of the connector body 10.

Also, as shown in FIG. 12, when the pressing piece 32 of the pressing member 30 is inserted toward the rear of the connector body 10, the gap between the pressing piece 32 and the bottom face portion 14 is gradually narrowed through the flexible cable A, and the flexible cable A is pressed onto the bottom face portion 14 side by the pressing piece 32. At this time, the flexible cable A and the elastic piece portion 22 of each of the terminals 20 are brought into pressure contact with each other and electrically connected.

In this way, according to the connector of this preferred embodiment, the temporary holding member 40 which is elastically deformed upward while being in contact with the upper face of the flexible cable A inserted into the connector body 10 and fitted with the notch portion A2 of the flexible cable A while recovering when the flexible cable A is inserted till it is brought into contact with the front face of each of the terminal holes 12*a* of the connector body 10 is provided on both ends in the arranging direction of each of the terminals 20 of the connector body 10. And when the temporary holding member 40 is fitted with the notch portion A2, the feeling that each of the temporary holding members 40 is fitted with the notch portion A2 of the flexible cable 2 while recovering to the original shape is obtained through the flexible cable A. Also, the flexible cable A is locked by the terminal hole 12*a* and the temporary holding member 40 in the fore-and-aft direction of the connector body 10. Therefore, since incomplete insertion of the flexible cable A can be prevented, withdrawal of the flexible cable A from the connector body 10 or displacement between the conductive portion A1 of the flexible cable A and the elastic piece portion 22 of each of the terminals 20, which results in contact failure, can be surely prevented.

In the above preferred embodiment, an example constituted so that the feeling can be obtained when each of the temporary holding members 40 formed so as to be elastically deformed temporarily presses the flexible cable A is shown, but a temporary holding member made of a non-elastic member may be provided.

The invention claimed is:

1. A connector provided with a connector body to which one end of an object to be connected and inserted at a predetermined position, a plurality of terminals in contact with the object to be connected and inserted into the connector body, and a pressing member for pressing the object to be connected to each of the terminals side by being inserted into the connector body, in which a lock portion is projected on both ends in the terminal arranging direction of the connector body, and when the object to be connected is inserted into the connector body, the tip end side of the object to be connected overrides the lock portion and a notch portion provided on both side ends of the object to be connected is fitted with and locked by the lock portion in the direction opposite to insertion, wherein said lock portion is formed by a non-elastic member and a temporary holding member which is elastically deformed in a predetermined direction while being in contact with one face of the object to be connected inserted into the connector body and is recovered while urging the object to be connected in the direction of fitting with the lock portion when the notch portion of the object to be connected is fitted with the lock portion is provided on both ends in the terminal arranging direction of the connector body.

2. The connector according to claim 1, wherein said lock portion is integrally formed with the connector body.

3. The connector according to claim 1, wherein the front end of said lock portion is formed so that it is upwardly inclined toward the rear of the connector body.

4. The connector according to claim 1, wherein said lock portion is formed higher than the height of each of the terminals protruding in the direction in contact with the object to be connected.

5. The connector according to claim 2, wherein said lock portion is formed integrally with the connector body.

6. The connector according to claim 2, wherein said lock portion is formed higher than the height of each of the terminals protruding in the direction in contact with the object to be connected.

7. The connector according to claim 3, wherein said lock portion is formed higher than the height of each of the terminals protruding in the direction in contact with the object to be connected.

8. The connector according to claim 1, wherein said temporary holding member is provided with a connection portion to be connected to a board to which the connector body is connected.

9. The connector according to claim 2, wherein said temporary holding member is provided with a connection portion to be connected to a board to which the connector body is connected.

10. The connector according to claim 3, wherein said temporary holding member is provided with a connection portion to be connected to a board to which the connector body is connected.

11. The connector according to claim 4, wherein said temporary holding member is provided with a connection portion to be connected to a board to which the connector body is connected.

12. The connector according to claim 5, wherein said temporary holding member is provided with a connection portion to be connected to a board to which the connector body is connected.

13. The connector according to claim 6, wherein said temporary holding member is provided with a connection portion to be connected to a board to which the connector body is connected.

14. The connector according to claim 7, wherein said temporary holding member is provided with a connection portion to be connected to a board to which the connector body is connected.

* * * * *